US008610448B2

(12) United States Patent
Kim

(10) Patent No.: US 8,610,448 B2
(45) Date of Patent: Dec. 17, 2013

(54) ONE-SHEET TEST DEVICE AND TEST METHOD THEREOF

(75) Inventor: Sung-Woo Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 440 days.

(21) Appl. No.: 12/900,375

(22) Filed: Oct. 7, 2010

(65) Prior Publication Data

US 2011/0084700 A1 Apr. 14, 2011

(30) Foreign Application Priority Data

Oct. 14, 2009 (KR) ..... 10-2009-0097763

(51) Int. Cl.
*G01R 31/26* (2006.01)
*G01R 31/02* (2006.01)

(52) U.S. Cl.
USPC ..... 324/762.01; 32/762.05; 32/763.01

(58) Field of Classification Search
USPC ..... 324/403, 760.01, 760.02, 770, 762.01, 324/762.05, 120
See application file for complete search history.

(56) References Cited

U.S. PATENT DOCUMENTS 5,719,648 A * 2/1998 Yoshii et al. ..... 349/42
6,172,410 B1 * 1/2001 Nagata et al. ..... 257/620
6,281,701 B1 * 8/2001 Yang et al. ..... 324/754.03
6,366,112 B1 * 4/2002 Doherty et al. ..... 324/754.18
7,170,311 B2 * 1/2007 Yu et al. ..... 324/760.01
7,355,418 B2 * 4/2008 Brunner et al. ..... 324/750.25
7,605,599 B2 * 10/2009 Kwak et al. ..... 324/760.01
2007/0001711 A1 * 1/2007 Kwak ..... 324/770
2007/0296437 A1 * 12/2007 Johnston et al. ..... 324/761
2008/0094096 A1 * 4/2008 Kishimoto et al. ..... 324/765
2008/0169822 A1 * 7/2008 Kwak ..... 324/537

(Continued)

FOREIGN PATENT DOCUMENTS

JP 2007-271585 10/2007
JP 2008-122362 5/2008

(Continued)

OTHER PUBLICATIONS

Korean Patent Abstracts, Publication No. KR 10-2007-0001583, dated Jan. 4, 2007, corresponding to Korean Patent 10-0673749.

(Continued)

*Primary Examiner* — Huy Q Phan
*Assistant Examiner* — James Split
(74) *Attorney, Agent, or Firm* — Christie, Parker & Hale, LLP

(57) ABSTRACT

A one-sheet test device for testing panels on a one-sheet substrate and a test method thereof, wherein the test device and method are capable of performing a one-sheet test regardless of the number of panels formed on the one-sheet substrate. The one-sheet test device includes a signal supplier and a connection board. The signal supplier is for generating a plurality of signal groups and a plurality of dummy signals for testing the panels. The connection board is for transmitting a first signal group of the signal groups to a first panel of the panels corresponding to the first signal group, and for transmitting a signal of at least one signal group of the plurality of signal groups to at least two of the panels when the number of panels is larger than the number signal groups. The one-sheet test device may include a connection controller for controlling the connection board.

9 Claims, 5 Drawing Sheets

(56) References Cited

U.S. PATENT DOCUMENTS

| | | | | |
|---|---|---|---|---|
| 2009/0015825 | A1* | 1/2009 | Chung | 356/239.2 |
| 2009/0115772 | A1* | 5/2009 | Shiomi et al. | 345/214 |
| 2009/0295424 | A1* | 12/2009 | Guo et al. | 324/770 |
| 2010/0073009 | A1* | 3/2010 | Wang et al. | 324/537 |

FOREIGN PATENT DOCUMENTS

| | | | |
|---|---|---|---|
| KR | 10-0673749 | B1 | 1/2007 |
| KR | 10-0721954 | B1 | 5/2007 |
| KR | 10-0766946 | | 10/2007 |
| KR | 10-2008-0017972 | | 2/2008 |
| KR | 10-0833755 | B1 | 5/2008 |
| KR | 10-0858610 | B1 | 9/2008 |

OTHER PUBLICATIONS

Korean Patent Abstracts, Publication No. KR 10-2007-0032485, dated Mar. 22, 2007, corresponding to Korean Patent 10-0721954.

* cited by examiner

ONE-SHEET TEST DEVICE AND TEST METHOD THEREOF

CROSS-REFERENCE TO RELATED APPLICATION

This application claims priority to and the benefit of Korean Patent Application No. 10-2009-0097763, filed in the Korean Intellectual Property Office on Oct. 14, 2009, the entire content of which is incorporated herein by reference.

BACKGROUND

1. Field

Aspects of the present invention relate to a one-sheet test device and a test method thereof.

2. Description of Related Art

In general, after panels of a plurality of organic light emitting displays are formed on one substrate (hereinafter referred to as a "one-sheet substrate"), the panels are scribed to be separated into individual panels. Before the panels are cut or separated from the one-sheet substrate, diagnostics such as lighting by the panel unit, a test process, an aging process by the panel unit, or the like, are performed on the sheet structure. In the above-mentioned process, a signal is provided to the one-sheet substrate by using a common wire at the side of the one-sheet substrate in order to drive each panel.

However, as product development models are varied, the sizes and number of the panels formed on the one-sheet substrate vary. Since the known one-sheet test devices are designed to test one-sheet substrates having panels of limited sizes and number, when the sizes and number of the panels vary, it may be very difficult to test the one-sheet substrates. Further, solving the problem by modifying or redesigning the test device increases the manufacturing cost.

The above information disclosed in this Background section is only for enhancement of understanding of the background of the invention and therefore it may contain information that does not form the prior art that is already known in this country to a person of ordinary skill in the art.

SUMMARY

Embodiments of the present invention provide a one-sheet test device and a test method thereof that can test a one-sheet substrate regardless of the number of panels formed on the one-sheet substrate.

According to an embodiment of the present invention, a one-sheet test device is provided. The one-sheet test device is configured to test a one-sheet substrate that includes a plurality of panels. The one-sheet test device includes a signal supplier and a connection board. The signal supplier is for generating a plurality of signal groups and a plurality of dummy signals for testing the plurality of panels. The connection board is for transmitting a first signal group of the plurality of signal groups to a first panel of the plurality of panels corresponding to the first signal group, and transmitting a signal of at least one signal group of the plurality of signal groups to at least two panels of the plurality of panels when a number of the plurality of panels is larger than a number of the plurality of signal groups.

Each of the plurality of signal groups may include red, green, and blue data signals, a gate signal, and a power signal.

The plurality of dummy signals may correspond to the red, green, and blue data signals and the gate signal.

The connection board may further be for transmitting the plurality of dummy signals to one of the at least two panels, for transmitting the red, green, and blue data signals and the gate signal of the at least one signal group to an other of the at least two panels, and for transmitting the power signal of the at least one signal group to the one of and the other one of the at least two panels.

The connection board may output only signal groups of the plurality of signal groups corresponding to the plurality of panels when the number of the plurality of panels is not larger than the number of the plurality of signal groups.

According to another embodiment of the present invention, a test method of a one-sheet test device is provided. The test method includes generating a plurality of signal groups and a plurality of dummy signals for testing a one-sheet substrate including a plurality of panels, transmitting a first signal group of the plurality of signal groups to a first panel of the plurality of panels corresponding to the first signal group, and transmitting a signal of at least one signal group of the plurality of signal groups to at least two panels of the plurality of panels when a number of the plurality of panels is larger than a number of the plurality of signal groups.

Each of the plurality of signal groups may include red, green, and blue data signals, a gate signal, and a power signal.

The test method may further include generating the plurality of dummy signals at levels corresponding to the red, green, and blue data signals and the gate signal.

The transmitting the signal of the at least one signal group to the at least two panels of the plurality of panels may include transmitting the plurality of dummy signals to one of the at least two panels; transmitting the red, green, and blue data signals and the gate signal of the at least one signal group to an other one of the at least two panels; and transmitting the power signal of the at least one signal group to the one of and the other one of the at least two panels.

The test method may further include outputting only signal groups of the plurality of signal groups corresponding to the plurality of panels when the number of the plurality of panels is not larger than the number of the plurality of signal groups.

According to yet another embodiment of the present invention, a one-sheet test device is provided. The one-sheet test device is configured to test a one-sheet substrate that includes a plurality of panels. The one-sheet test device includes a signal supplier, a connection board, and a connection controller. The signal supplier is for generating a plurality of signal groups and a plurality of dummy signals for testing the plurality of panels. The connection board is for transmitting the plurality of signal groups and the plurality of dummy signals to the plurality of panels. The connection controller is for controlling the connection board. The connection controller is configured to control the connection board to transmit a first signal group of the plurality of signal groups to a first panel of the plurality of panels corresponding to the first signal group, and transmit a signal of at least one signal group of the plurality of signal groups to at least two panels of the plurality of panels when a number of the plurality of panels is larger than a number of the plurality of signal groups.

Each of the plurality of signal groups may include red, green, and blue data signals, a gate signal, and a power signal.

The plurality of dummy signals may correspond to the red, green, and blue data signals and the gate signal.

The connection controller may be further configured to control the connection board to transmit the plurality of dummy signals to one of the at least two panels, transmit the red, green, and blue data signals and the gate signal of the at least one signal group to an other of the at least two panels, and transmit the power signal of the at least one signal group to the one of and the other one of the at least two panels.

The connection controller may be further configured to control the connection board to output only signal groups of the plurality of signal groups corresponding to the plurality of panels when the number of the plurality of panels is not larger than the number of the plurality of signal groups.

As described above, according to embodiments of the present invention, it is possible to test a one-sheet substrate regardless of the number of panels formed on the one-sheet substrate.

BRIEF DESCRIPTION OF THE DRAWINGS

The accompanying drawings, together with the specification, illustrate exemplary embodiments of the present invention and, together with the description, serve to explain the principles of the present invention.

DETAILED DESCRIPTION

Figure 1:
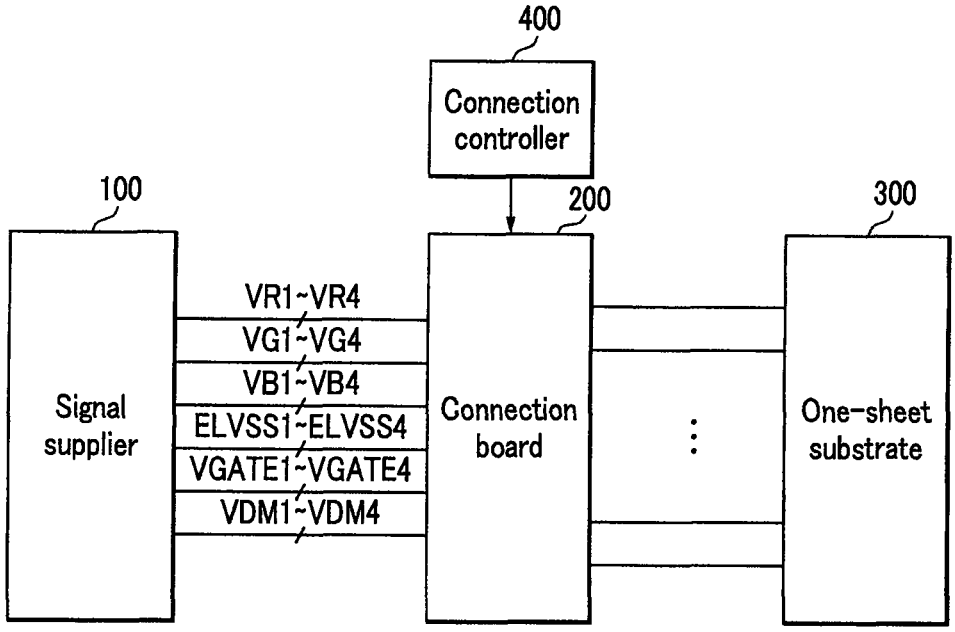
FIG. 1 is a diagram showing a one-sheet test device according to an embodiment of the present invention.

In the following description, certain exemplary embodiments of the present invention are shown and described with reference to the accompanying drawings, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

In this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a diagram showing a one-sheet test device according to an embodiment of the present invention.

Referring to FIG. 1, the one-sheet test device according to an embodiment of the present invention includes a signal supplier 100, a connection board 200, and a connection controller 400 for testing a one-sheet substrate 300. The signal supplier 100 generates a plurality of test signals for testing a plurality of cells (panels) constituting the one-sheet substrate 300. The number of output pins of the signal supplier 100 is determined at a design stage of the signal supplier 100. One signal is outputted from each output pin of the signal supplier 100, and in an embodiment of the present invention, the signal supplier 100 having 28 output pins is shown for convenience of description, but the present invention is not limited thereto.

The signal supplier 100 generates a plurality of data signals. In one embodiment, the signal supplier 100 is for testing color display panels, and the signals include a plurality of data signals VR1 to VR4, VG1 to VG4, and VB1 to VB4, a first power signal ELVDD, a plurality of second power signals ELVSS1 to ELVSS4, and a plurality of gate signals VGATE1 to VGATE4. When a one-sheet substrate is tested, the first power signal ELVDD is selectively supplied to one of the plurality of cells of the one-sheet substrate 300. It can be determined whether a cell supplied with the first power signal ELVDD is erroneous by sensing line current to which the first power signal ELVDD is transmitted.

The plurality of data signals VR1 to VR4, VG1 to VG4, and VB1 to VB4 include red data signals VR1 to VR4 supplied to a plurality of red sub-pixels of a corresponding cell of the plurality of cells constituting the one-sheet substrate 300, green data signals VG1 to VG4 supplied to a plurality of green sub-pixels of a corresponding cell of the plurality of cells constituting the one-sheet substrate 300, and blue data signals VB1 to VB4 supplied to a plurality of blue sub-pixels of a corresponding cell of the plurality of cells constituting the one-sheet substrate 300. The plurality of second power signals ELVSS1 to ELVSS4 are signals for driving the plurality of pixels of the corresponding cells of the plurality of cells constituting the one-sheet substrate 300. The plurality of gate signals VGATE1 to VGATE4 are signals for transmitting the corresponding data signal to the plurality of pixels of the corresponding cell among the plurality of cells constituting the one-sheet substrate 300.

The signal supplier 100 further may output a plurality of dummy signals, such as dummy signals VDM1 to VDM4 in FIG. 1. In an embodiment of the present invention, it is possible to test a one-sheet substrate 300 that includes more cells than the number of groups of test signals outputted from the signal supplier 100 by using the plurality of dummy signals VDM1 to VDM4. Hereinafter, a plurality of test signals for testing one cell (hereinafter referred to as a "panel") among the plurality of test signals outputted from the signal supplier 100 will be described by being defined as one signal group. For example, a first signal group includes red, green, and blue data signals VR1, VG1, and VB1, second power signal ELVSS1, and gate signal VGATE1, while a second signal group includes red, green, and blue data signals VR2, VG2, and VB2, second power signal ELVSS2, and gate signal VGATE2. That is, the signal supplier 100 according to an embodiment of the present invention generates four signal groups (e.g., the first signal group includes red data signal VR1, green data signal VG1, blue data signal VB1, second power signal ELVSS1, and gate signal VGATE1, and the second, third, and fourth signal groups respectively include corresponding similar signals) and four dummy signals VDM1 to VDM4.

The connection board 200 is controlled by the connection controller 400 to transmit the plurality of signal groups to corresponding panels of the plurality of panels constituting the one-sheet substrate 300. The connection controller 400 determines a signal group outputted from the connection board 200 depending on the number of the plurality of signal groups and the number of the plurality of panels constituting the one-sheet substrate 300. A detailed description thereof will be given with reference to FIGS. 2 through 5.

Figure 2:
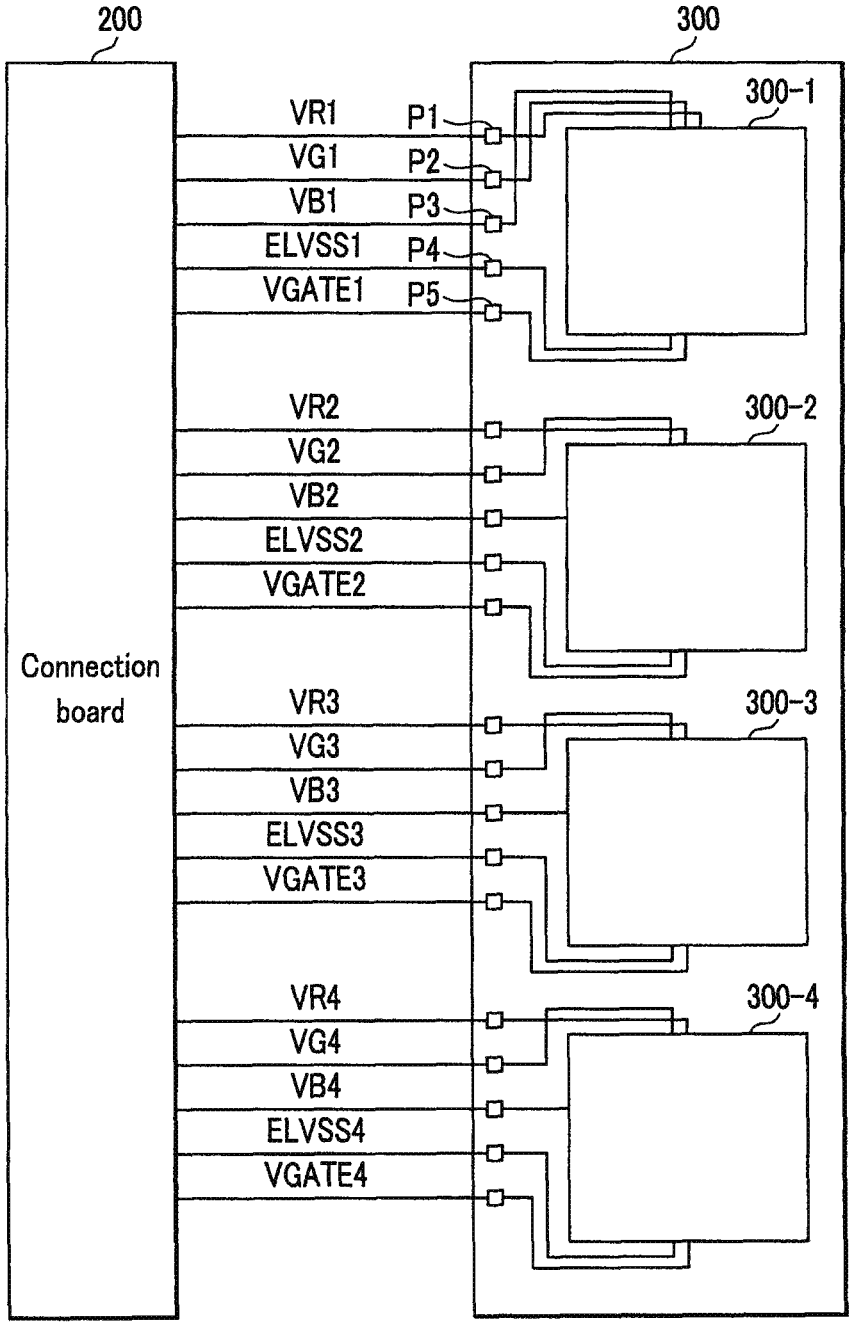
FIGS. 2 to 5 are diagrams for illustrating a test method of a one-sheet test device according to an embodiment of the present invention.
Figure 3:
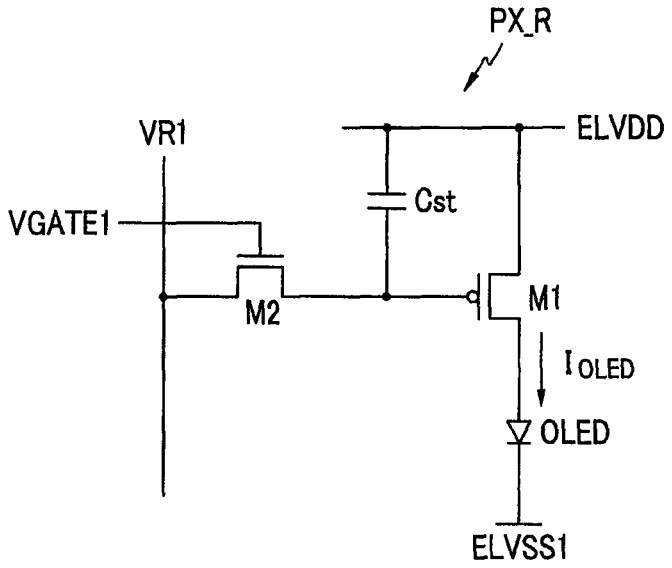
Figure 4:
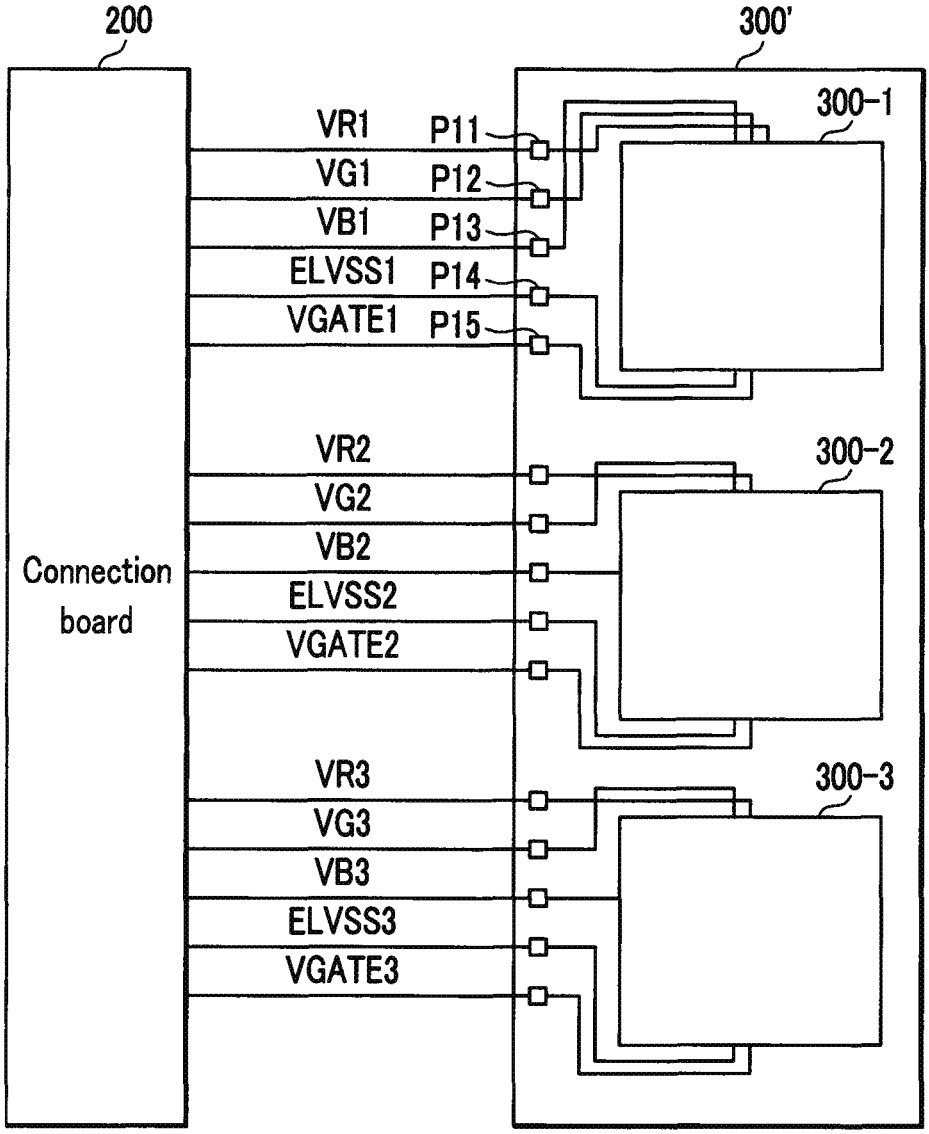
Figure 5:
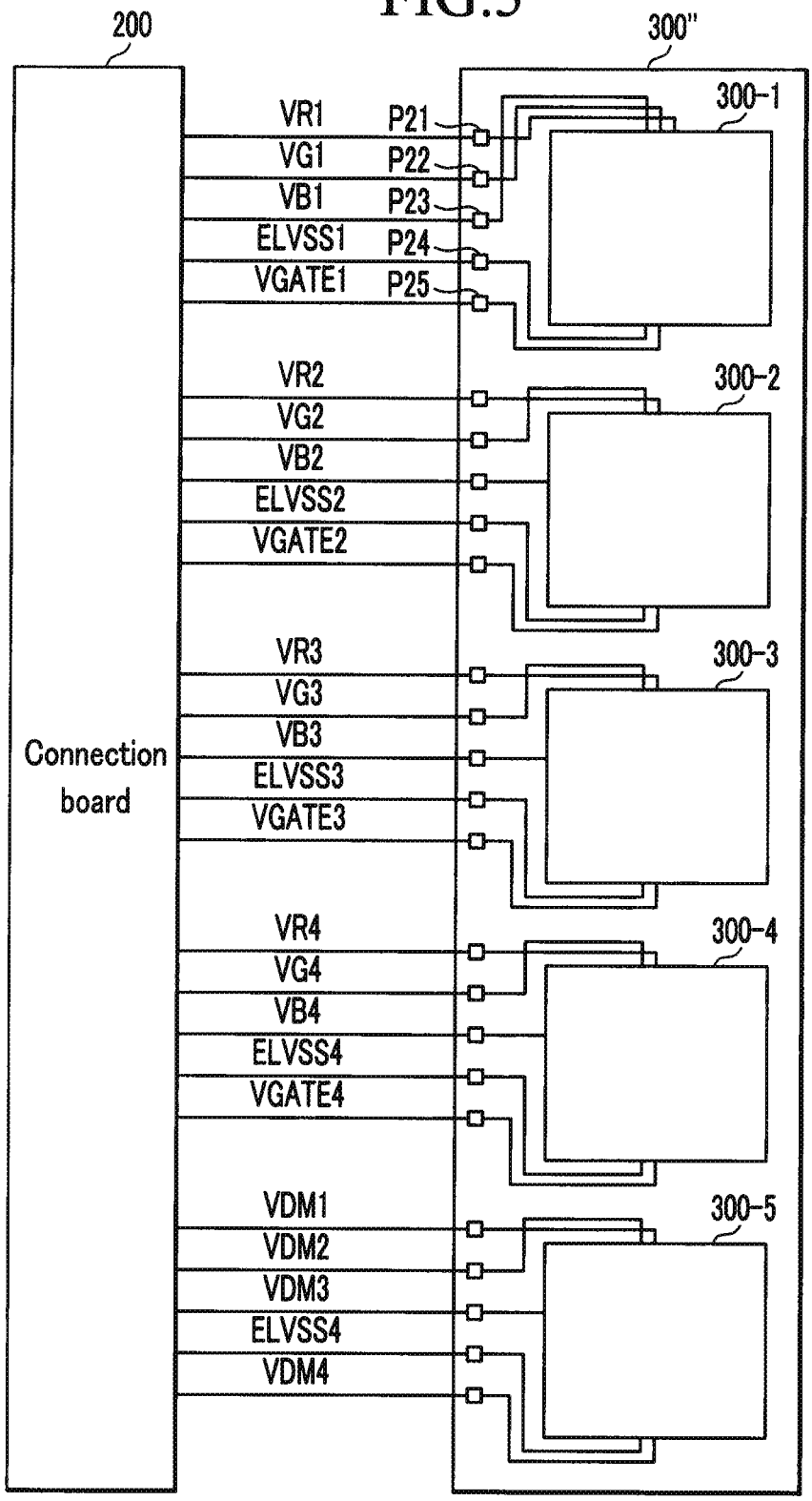

FIGS. 2 to 5 are diagrams for illustrating a test method of a one-sheet test device according to an embodiment of the present invention, in this case testing a sheet including color display panels. Herein, FIG. 2 is a schematic diagram for illustrating a connection relationship between the connection board 200 and the one-sheet substrate 300 when 4 panels are formed on the one-sheet substrate 300, and FIG. 3 is an equivalent circuit diagram of a red sub-pixel included in a first panel 300_1 shown in FIG. 2. FIG. 4 shows a case in which three panels are formed on the one-sheet substrate 300', and FIG. 5 shows a case in which five panels are formed on the one-sheet substrate 300". Only one array (e.g., column) of the panels shown in FIGS. 2 to 5 is shown for convenience of description, but the present invention is not limited thereto and may include a plurality of arrays (e.g., columns).

First, referring to FIG. 2, first to fourth panels 300_1 to 300_4 and a plurality of pads for transmitting signals to the first to fourth panels 300_1 to 300_4 are formed on the one-sheet substrate 300. The first to fourth panels 300_1 to 300_4 each include a plurality of pixels PX. Each of the pixels PX includes 3 sub-pixels, that is, a red sub-pixel PX_R, a green sub-pixel PX_G, and a blue sub-pixel PX_B.

Each sub-pixel of pixel PX, e.g., the red sub-pixel PX_R included in the first panel 300_1, includes an organic light emitting diode (OLED), a driving transistor M1, a capacitor Cst, and a switching transistor M2, as shown in FIG. 3. The sub-pixel may also include a light emission control transistor between the driving transistor M1 and the OLED. The driving transistor M1 receives a first power signal ELVDD at a source terminal thereof, and is connected to an anode terminal of the OLED at a drain terminal thereof. The driving transistor M1 is connected to a drain terminal of the switching transistor M2 at a gate terminal thereof. The driving transistor M1 allows current $I_{OLED}$ (of which magnitude varies depending on a voltage applied between the gate terminal and the source terminal) to flow to the OLED.

The switching transistor M2 receives a first gate signal VGATE1 at a gate terminal thereof, and receives a first red data signal VR1 at a source terminal thereof. The switching transistor M2 performs a switching operation in response to the first gate signal VGATE1. When the switching transistor M2 is turned on, a voltage corresponding to the first red data signal VR1 is transmitted to the gate terminal of the driving transistor M1.

The capacitor Cst is connected between the source terminal and the gate terminal of the driving transistor M1. The capacitor Cst charges the data voltage applied to the gate terminal of the driving transistor M1 and maintains this even after the switching transistor M2 is turned off. The OLED receives a second power signal ELVSS1 at a cathode terminal thereof. The OLED emits light of intensity that varies depending on the current $I_{OLED}$ that the driving transistor M1 supplies.

The connection controller 400 (shown in FIG. 1) controls the connection board 200 to output the first to fourth signal groups when the number of the panels constituting the one-sheet substrate 300 corresponds to the number of the signal groups, as shown in FIG. 2. More specifically, the connection controller 400 controls the connection board 200 so as to transmit the first signal group, that is, the red, green, and red data signals VR1, VG1, and VB1, the second power signal ELVSS1, and the gate signal VGATE1 to the plurality of pads P1 to P5 connected to the first panel 3001 from the connection board 200. By this configuration, the connection controller 400 controls the connection board 200 so as to transmit the second to fourth signal groups to the plurality of pads connected to the second to fourth panels 300_2 to 300_4 corresponding to the second to fourth signal groups, respectively. In FIG. 2, the connection controller 400 (shown in FIG. 1) controls the connection board 200 to not transmit the plurality of dummy signals VDM1 to VDM4 to any pad.

In FIG. 4, the number of the panels of the one-sheet substrate 300' is smaller than the number of signal groups. Accordingly, the connection controller 400 (shown in FIG. 1) controls the connection board 200 to output only signal groups corresponding to the number of the panels. More specifically, the connection controller 400 controls the connection board 200 to transmit each signal of the first signal group to a plurality of pads P11 to P15 connected to the first panel 300_1 from the connection board 200. In addition, the connection controller 400 controls the connection board 200 so as to transmit the signals of the second and third signal groups to the plurality of pads of the second and third panels 300_2 and 300_3 corresponding to the second and third signal groups, respectively. Here, the connection controller 400 (shown in FIG. 1) controls the connection board 200 to not transmit the fourth signal group and the plurality of dummy signals VDM1 to VDM4 to any pad.

In FIG. 5, the number of the panels of the one-sheet substrate 300" is larger than the number of signal groups. That is, there are five panels 300_1 to 300_5 in the embodiment of FIG. 5. Accordingly, the connection controller 400 controls the connection board 200 so as to transmit the first to fourth signal groups to each of panels 300_1 to 300_4, respectively, of the one-sheet substrate 300". In addition, one or more signals of at least one of the first to fourth signal groups (in this case, the fourth signal group) and the plurality of dummy signals VDM1 to VDM4, are transmitted to at least two panels (in this case, panels 300_4 and 300_5). More specifically, the connection controller 400 controls the connection board 200 so as to transmit each signal of the first signal group to a plurality of pads P21 to P25 connected to the first panel 300_1. Likewise, the connection controller 400 controls the connection board 200 so as to transmit the signals of the second and third signal groups to the plurality of pads of the second and third panels 300_2 and 300_3 corresponding to the second and third signal groups, respectively.

In addition, the connection controller 400 controls the connection board 200 so as to transmit a second power signal ELVSS4 of the fourth signal group to fourth and fifth panels 300_4 and 300_5. Herein, the fourth signal group includes red, green, and blue data signals VR4, VG4, and VB4, and gate signal VGATE4 transmitted to a plurality of pads connected to the fourth panel 300_4, and a plurality of dummy signals VDM1 to VDM4 transmitted to a plurality of pads connected to the fifth panel 300_5, respectively. In FIG. 5, the plurality of dummy signals VDM1 to VDM4 are generated at levels of red, green, and blue data signals VR5, VG5, and VB5, and gate signal VGATE5, respectively. In addition, a second power signal ELVSS4 of the fourth signal group is commonly transmitted to the plurality of pads connected to the fourth and fifth panels 300_4 and 300_5.

Accordingly, according to embodiments of the present invention, it is possible to perform a one-sheet test for panels of various numbers without increasing or decreasing the number of output pins of a signal generator 100 or a number of input pins of a connection board 200 depending on the number of panels formed on a one-sheet substrate 300.

While aspects of the present invention have been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A one-sheet test device configured to test a one-sheet substrate comprising a plurality of panels, the one-sheet test device comprising:

a signal supplier for generating a plurality of signal groups and a plurality of dummy signals for testing the plurality of panels, wherein each of the plurality of signal groups includes red, green, and blue data signals, a gate signal, and a power signal, and the plurality of dummy signals correspond to the red, green, and blue data signals and the gate signal; and a connection board for:

transmitting a first signal group of the plurality of signal groups to a first panel of the plurality of panels corresponding to the first signal group, and when a number of the plurality of panels is larger than a number of the plurality of signal groups:

transmitting a signal of at least one signal group of the plurality of signal groups to at least two panels of the plurality of panels, wherein transmitting the signal comprises transmitting the power signal of the at least one signal group to one of and an other one of the at least two panels;

transmitting the plurality of dummy signals to the one of the at least two panels; and transmitting the red, green, and blue data signals and the gate signal of the at least one signal group to the other one of the at least two panels.

2. The one-sheet test device of claim 1, wherein the connection board outputs only signal groups of the plurality of signal groups corresponding to the plurality of panels when the number of the plurality of panels is not larger than the number of the plurality of signal groups.

3. The one-sheet test device of claim 1, wherein the connection board is further configured to not transmit the plurality of dummy signals generated by the signal supplier when the number of the plurality of panels is equal to the number of the plurality of signal groups.

4. A test method of a one-sheet test device, comprising:

generating a plurality of signal groups and a plurality of dummy signals for testing a one-sheet substrate comprising a plurality of panels, wherein each of the plurality of signal groups includes red, green, and blue data signals, a gate signal, and a power signal and the plurality of dummy signals correspond to the red, green, and blue data signals and the gate signal;

transmitting a first signal group of the plurality of signal groups to a first panel of the plurality of panels corresponding to the first signal group; and when a number of the plurality of panels is larger than a number of the plurality of signal groups:

transmitting a signal of at least one signal group of the plurality of signal groups to at least two panels of the plurality of panels, wherein transmitting the signal comprises transmitting the power signal of the at least one signal group to one of and an other one of the at least two panels;

transmitting the plurality of dummy signals to the one of the at least two panels; and transmitting the red, green, and blue data signals and the gate signal of the at least one signal group to the other one of the at least two panels.

5. The test method of claim 4, further comprising outputting only signal groups of the plurality of signal groups corresponding to the plurality of panels when the number of the plurality of panels is not larger than the number of the plurality of signal groups.

6. The test method of claim 4, wherein one or more of the plurality of dummy signals generated and provided to a connection board are not transmitted through the connection board when the number of the plurality of panels is equal to the number of the plurality of signal groups.

7. A one-sheet test device configured to test a one-sheet substrate comprising a plurality of panels, the one-sheet test device comprising:

a signal supplier for generating a plurality of signal groups and a plurality of dummy signals for testing the plurality of panels, wherein each of the plurality of signal groups includes red, green, and blue data signals, a gate signal, and a power signal and the plurality of dummy signals correspond to the red, green, and blue data signals and the gate signal;

a connection board for transmitting the plurality of signal groups and the plurality of dummy signals to the plurality of panels; and a connection controller for controlling the connection board, wherein the connection controller is configured to control the connection board to:

transmit a first signal group of the plurality of signal groups to a first panel of the plurality of panels corresponding to the first signal group, and when a number of the plurality of panels is larger than a number of the plurality of signal groups:

transmit a signal of at least one signal group of the plurality of signal groups to at least two panels of the plurality of panels, wherein transmitting the signal comprises transmitting the power signal of the at least one signal group to one of and an other one of the at least two panels;

transmit the plurality of dummy signals to the one of the at least two panels; and transmit the red, green, and blue data signals and the gate signal of the at least one signal group to the other one of the at least two panels.

8. The one-sheet test device of claim 7, wherein the connection controller is further configured to control the connection board to output only signal groups of the plurality of signal groups corresponding to the plurality of panels when the number of the plurality of panels is not larger than the number of the plurality of signal groups.

9. The one-sheet test device of claim 7, wherein the connection controller is further configured to control the connection board to not transmit the plurality of dummy signals when the number of the plurality of panels is equal to the number of the plurality of signal groups.

* * * * *